United States Patent [19]

Nixon

[11] 4,086,866

[45] May 2, 1978

[54] ANCHORING DEVICES

[75] Inventor: Ralph Alan Nixon, Hamilton, Scotland

[73] Assignee: United Kingdom of Great Britain and Northern Ireland, The Secretary of State for Industry in Her Britannic Majesty's Government of the, London, England

[21] Appl. No.: 751,996

[22] Filed: Dec. 17, 1976

Related U.S. Application Data

[63] Continuation-in-part of Ser. No. 561,788, Mar. 25, 1975, abandoned.

[30] Foreign Application Priority Data

Mar. 28, 1974 United Kingdom ..... 13847/74
Nov. 13, 1974 United Kingdom ..... 49197/74

[51] Int. Cl.[2] ..... B63B 21/26
[52] U.S. Cl. ..... 114/295
[58] Field of Search ..... 114/293–297; 61/53.58, 53.6, 53.64, 53.66, 53.68; 175/20, 67

[56] References Cited

U.S. PATENT DOCUMENTS

| | | | |
|---|---|---|---|
| 2,018,285 | 10/1935 | Schweitzer et al. | 175/67 |
| 3,431,879 | 3/1969 | Westling | 114/295 |
| 3,469,900 | 2/1970 | Mott et al. | 114/295 |
| 3,817,040 | 6/1974 | Stevens | 114/295 |
| 3,938,600 | 2/1976 | Essmeier | 175/67 |

FOREIGN PATENT DOCUMENTS

| | | | |
|---|---|---|---|
| 1,193,617 | 6/1970 | United Kingdom | 114/295 |
| 1,293,521 | 10/1972 | United Kingdom | 114/295 |

*Primary Examiner*—Trygve M. Blix
*Assistant Examiner*—Jesus D. Sotelo
*Attorney, Agent, or Firm*—Cameron, Kerkam, Sutton, Stowell & Stowell

[57] ABSTRACT

The anchoring device of the invention is one which buries itself vertically into the water bed material. In its common form the anchoring device is of generally cylindrical form and includes a centrally located suction passageway and fluidizing water outlets located in the general region of the lower open end of the suction passageway whereby in use and with suction applied to the suction passageway and fluidizing water made available through the fluidizing water outlets the bed material from immediately beneath the anchoring device is pumped through the body of the anchoring device and discharged above it.

19 Claims, 14 Drawing Figures

ANCHORING DEVICES

Figure 1:
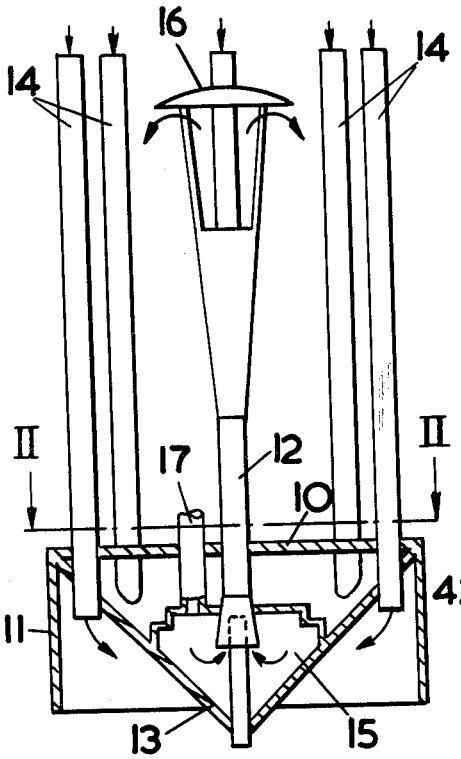

This is a continuation-in-part of application Ser. No. 561,788, filed Mar. 25, 1975, now abandoned.

This invention relates to improvements in underwater anchoring devices and in particular to deep burying anchoring devices which provide an anchorage by embedding themselves into the water bed. By deep burying it is meant generally but not exclusively to depths in excess of two diameters.

Currently known anchoring devices include anchors, piles and gravity-dependent systems. The most common method of anchoring, i.e. using a conventional anchor, suffers from the inherent disadvantage that the final siting of the anchor is uncertain since it has to be dragged an indeterminate distance before developing its full holding power. Its resistance to pullout load/self-weight is also relatively low and undesirable lengths of mooring chain are required to provide the necessary near-horizontal pull against the anchor. Piling is expensive and restricted for practical reasons to relatively small depths of burial and gravity-dependent systems are practicable only in soft mud and where the control of sinking is unimportant.

A known variation on the gravity-depending anchoring devices is the use of high pressure fluidising jets located adjacent the underside of the anchoring device and operative to fluidise the seabed material such that the anchoring device will then sink under its own weight. This method of anchoring however is limited to use in non-cohesive granular type seabeds such as sand or gravel since soft clays and muds cannot readily be fluidised by jetting action.

The object of the present invention is to provide an anchoring device capable of handling and functioning efficiently in bed materials comprising gravel, sand, mud and soft clay.

According to the present invention a device for providing an anchorage in the bed of a volume of water includes a body member, at least one suction passageway extending at least part way through the body member and fluidising water outlet means located in the general area of the lower open end of the suction passageway and positioned relative to the lower open end of the suction passageway such that in use, and with suction applied to the suction passageway and fluidising water made available through the outlet means, sufficient water is present in the region of the lower open end of the suction passageway to enable the bed material immediately below the body member to be transferred, through the suction passageway as solids in suspension in water, from below the body member whereby the body member will bury and continue to bury itself deeper into the water bed material.

In most applications the anchoring device would preferably include a single suction passageway located in the central region of the body member although larger anchoring devices might include the provision of several suction passageways each extending from above the body member to the open area beneath the body member.

In one arrangement of the invention the body member may include a conical portion arranged with the suction passageway extending through the apex of the conical portion and the fluidising water outlet means located in the region of the base of the conical portion.

In a first embodiment of the invention for use particularly with free running solids such as for example sand and gravel the conical portion may be in an inverted state with its apex extending downwardly towards the lower open end of the suction passageway and the body member advantageously may be provided with a peripheral skirt portion extending substantially vertically downwardly to shield the fluidising water outlet means and to contain the volume of bed material drawn up through the suction passageway to that immediately below the body member.

In this first embodiment the fluidising water outlet means may include a number of individual passageways extending from a lower position in the region adjacent the lower open end of the suction passageway to an upper position in the free water above the water bed whereby in use free water is always made available in the region of the lower open end of the suction passageway.

Alternatively the fluidising water outlet means may include a generally annular passageway in the peripheral base region of the conical portion, the annular passageway being fed in use with free water from above the water bed and there being provided in the boundary wall of the annular passageway a series of apertures through which the free water can be directed into the general region of the lower open end of the suction passageway.

The means for providing suction in the suction passageway to induce solids in suspension in water to pass through the passageway may conveniently be an annular jet pump fed by a supply of water under pressure. The annular stream of water is directed up the suction passageway and this action induces a core of solids/water to be drawn up from the water bed. Opposite the upper open end of the suction passageway there may be positioned an umbrella-like deflector which in use deflects the induced solids/water mixture drawn up from below the body member such that it settles over the body member.

Preferably the included angle at the apex of the conical portion is less than the included angle of the naturally formed conical depression formed in the water bed material when the water bed material is drawn up through the apex of the conical portion. Also in the preferred arrangement the lower open end of the suction passageway extends down below the lower region of the skirt portion to an extent whereby the angle of an imaginary line joining the lower region of the skirt portion to the lower open end of the suction passageway is less than the natural angle of repose of the water bed material when considered relative to the horizontal plane.

In a preferred arrangement of the first embodiment of the invention a device for providing an anchorage in the bed of a volume of water includes a body member comprising essentially an open ended cylindrical skirt portion, a conical portion mounted coaxially within the skirt position and with the apex region of the conical portion extending below the open end of the skirt portion, a suction passageway located along the axis of the skirt and conical portions and extending through the apex region of the conical portion, and fluidising water passageways arranged circumferentially around the suction passageway and having their lower ends extending through the wall of the conical portion into the space provided between the skirt and the conical portions whereby in use and with suction applied to the suction passageway a mixture of bed material/water from immediately below and within the skirt portion is drawn up the suction passageway and discharged over and above the anchoring device, necessary fluidising water for the efficient continued operation of the device being provided to the bed material via the fluidising water passageways.

In a second embodiment of the invention for use in a variety of bed materials including those containing soft clays and muds the fluidising water outlet means includes a toroidal ring located around the base of the conical portion and having a series of apertures in the inner circumferential region through which fluidising water can be directed into the general region of the lower open end of the suction passageway. Preferably the apertures are arranged to direct jets of fluidising water radially of the toroidal ring and also in a downwardly direction to form a cylindrical or conical form curtain of jetting water.

In an alternative arrangement of the second embodiment of the invention the fluidising water outlet means include a generally annular passageway in the peripheral base region of the body member, the annular passageway being fed in use with water under pressure and there being provided in the boundary wall of the annular passageway a series of apertures through which the water under pressure can be directed into the general region below the lower open end of the suction passageway.

The means for providing suction in the suction passageway to induce solids in suspension in water to pass through the passageway may conveniently be an air-lift pump operative by introducing air under pressure into the suction passageway just above its lower open end.

In yet a third embodiment of the invention for use in a variety of bed materials including those containing soft clays and muds the body member of the anchoring device comprises essentially a platform portion and depending therefrom a cylindrical skirt portion, the suction passageway extending at least through the platform portion, the device also having fluidising water outlet means located beneath the body member and ahead of the lower open end of the suction passageway.

The fluidising water outlet means is preferably a single jet nozzle positioned co-axially with the suction passageway some short distance beneath the lower periphery of the skirt portion so as to be at the apex of an imaginary shallow cone formed with the lower periphery of the skirt portion as its base. The base angle of the imaginary cone is preferably between 25° and 40°, the exact angle being dependent upon the angle of repose of the bed material into which the device is to be buried.

Secondary fluidising water outlet means located in the general region around the lower open end of the suction passageway might also be provided and in one arrangement of the third embodiment of the invention including secondary fluidising water outlet means there is provided an annular chamber in or on the platform portion of the body member, the annular chamber being in fluid connection with both the main and secondary fluidising water outlet means and arranged in use to supply water under pressure to both the main and secondary fluidising water outlet means.

The secondary fluidising water outlet means may comprise a series of individual jets located within the skirt portion and arranged in use to direct a curtain of fluidising water towards the lower peripheral region of the skirt portion. Preferably the individual jets are in the form of short lengths of tubing extending from the annular chamber in a frusto-conical pattern.

As with the second embodiment the means for providing suction in the suction passageway to induce solids in suspension in water to pass through the passageway may conveniently be an air-lift pump operative by introducing air under pressure into the suction passageway just above its lower open end.

In a fourth embodiment based upon the general arrangements of the third embodiment the means for providing a suction in the suction passageway is a water-jet pump fed in use with water under pressure from the same source as that supplying the fluidizing outlet means. The water-jet pump comprises essentially a water jet nozzle through which water under pressure might be ejected into the suction passageway. The water-jet nozzle is arranged coaxially with the suction passageway and the fluidizing water outlet means, both being in fluid connection with the source of fluidizing water.

A fifth embodiment again based upon the general arrangement of the third embodiment is provided with a solids handling pump mounted upon or designed within the body of the anchoring device. In a preferred arrangement the solids handling pump is a centrifugal pump in which the inlet into the pump is the suction passageway and the exhaust from the pump the continuation of the suction/extraction passageway through which in use the bed material passing through the body of the anchoring device is discharged.

The centrifugal pump includes an impeller rotatably attached to the rotating member of a motor which in a preferred arrangement is an hydraulic motor. The hydraulic motor may conveniently be designed to operate with water or sea-water as its working fluid.

Means for releasing the anchoring device from a position within the water bed material may conveniently be the controlled release of water under pressure in the region immediately above the body member of the anchoring device. Such means may conveniently comprise a toroidal ring having a series of apertures through which water under pressure may be directed to cause fluidising of the water bed material immediately above the body member of the anchoring device such that the anchoring device might be withdrawn from within the water bed material.

A method of sinking an anchoring device particularly into a bed of free running solids comprises transferring bed material from immediately below the anchoring device to immediately above the anchoring device and includes the steps of applying a suction to the lower central region of the device to cause bed material in suspension in the water to be drawn up and passed through the body of the device while simultaneously providing in the immediate vicinity of the area from where the bed material/water is being drawn up a sufficient supply of fluidising water to enable continuous operation of the transferring of bed material from below to above the device to be continued.

Alternatively a method of sinking an anchoring device into the bed of a volume of water includes the steps of providing in the region immediately beneath the anchoring device a supply of fluidising water under pressure to agitate and convert the bed material into a pumpable material whereafter such pumpable bed material is pumped in suspension in water through the central region of the anchoring device whereafter the anchoring device settles down under gravity into the excavated area immediately beneath it thereby burying itself more deeply into the bed material.

Figure 3:
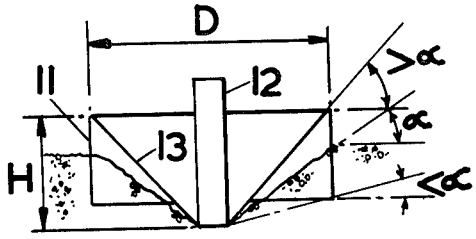
Figure 4:
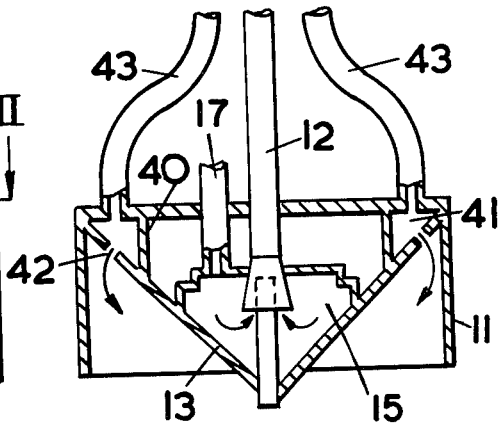
Figure 2:
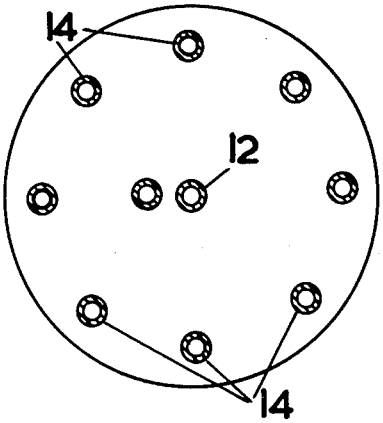
Figure 5:
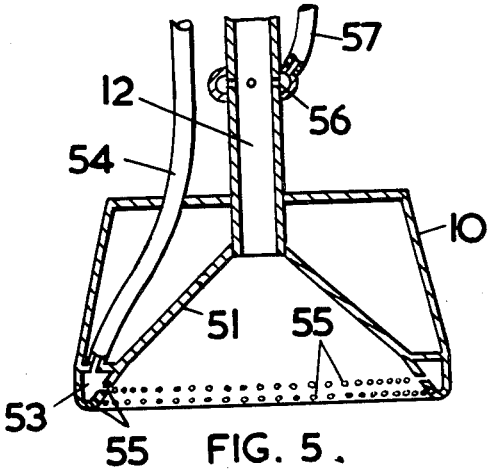
Figure 6:
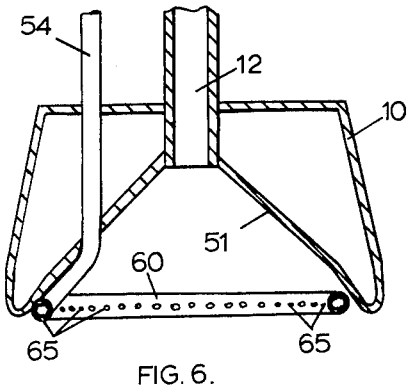
Figure 7:
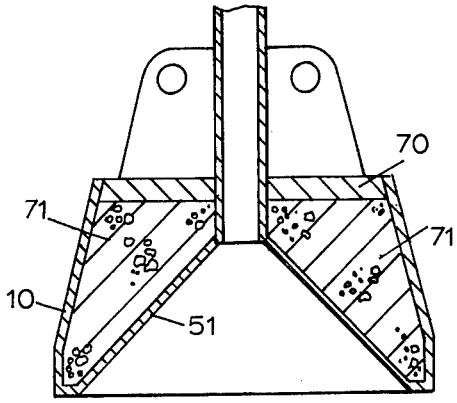
Figure 8:
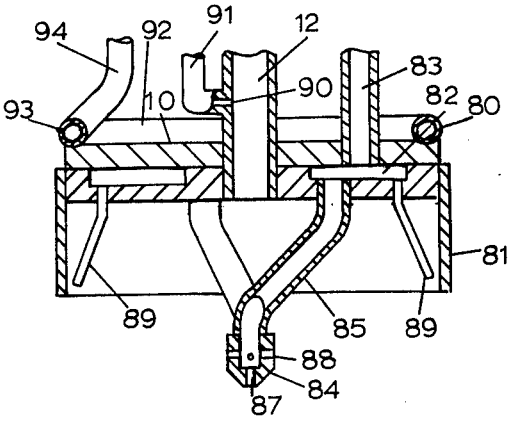
Figure 9:
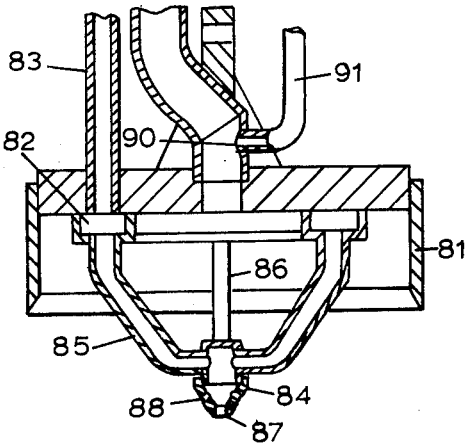
Figure 10:
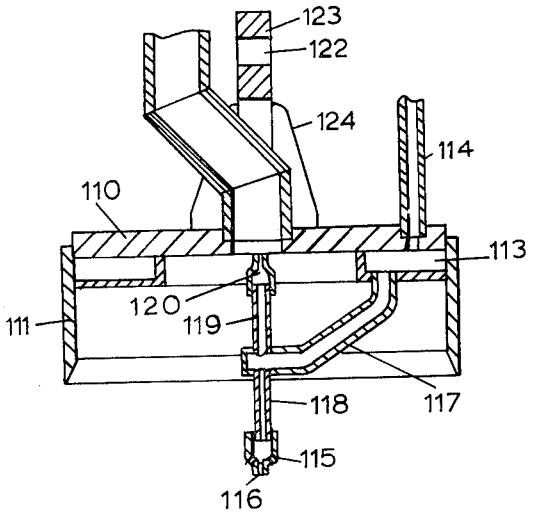
Figure 11:
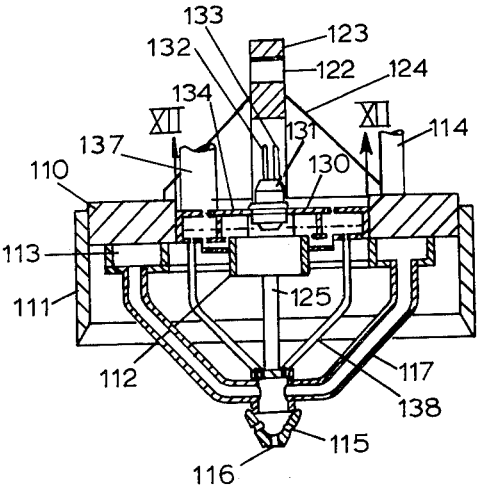

Various embodiments of the invention demonstrating the principles of the invention will now be described by way of example only and with reference to the accompanying diagrammatic drawings in which:

FIG. 1 illustrates a vertical section through a typical anchoring device in accordance with a first embodiment of the invention and utilising free-flowing fluidising water, FIG. 2 is a view on the section II—II of FIG. 1, FIG. 3 illustrates the general geometry of the lower portion of the anchoring device of FIG. 1, FIG. 4 illustrates an alternative design of the anchoring device of FIG. 1, FIG. 5 illustrates a vertical section through a typical anchoring device in accordance with a second embodiment of the invention and utilising fluidising water supplied under pressure, FIG. 6 illustrates an alternative design of the anchoring device of FIG. 5, FIG. 7 illustrates the general form a typical production anchoring device of FIGS. 5 or 6 could take, FIGS. 8 and 9 illustrate vertical sections through typical anchoring devices in accordance with a third embodiment of the invention, FIG. 10 illustrates a vertical section through a typical anchoring device in accordance with a fourth embodiment of the invention, FIG. 11 illustrates a vertical section through a typical anchoring device in accordance with a fifth embodiment of the invention.

Figure 13:
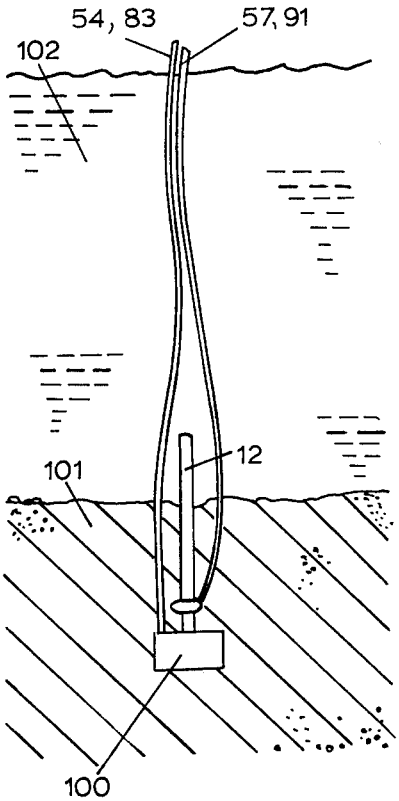
Figure 12:
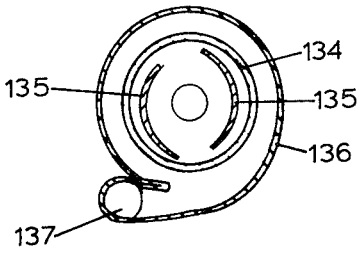
Figure 14:
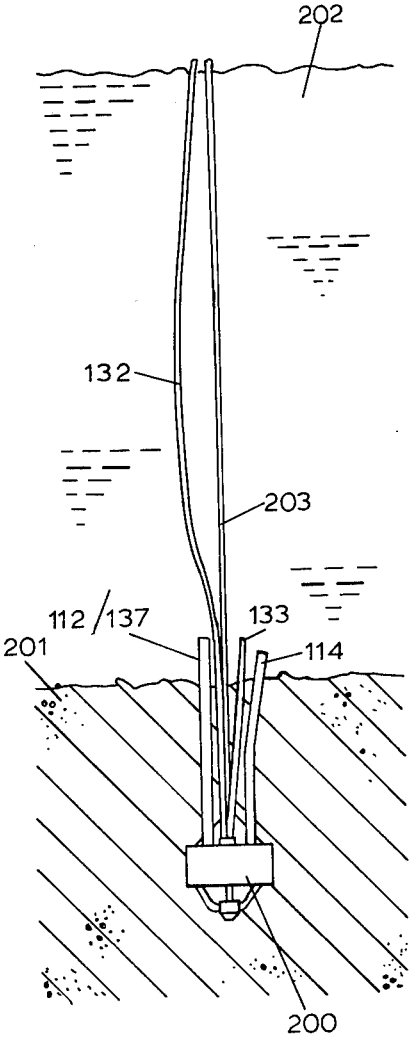

FIG. 12 is a scrap view on the section XII—XII of FIG. 11,

FIG. 13 is a schematic representation of an anchoring device of the second (FIGS. 5, 6 and 7) or third (FIGS. 8 and 9) embodiments of the invention embedded in a water bed material and, FIG. 14 is a schematic representation of an anchoring device of the fifth embodiment (FIGS. 11 and 12) of the invention embedded in a water bed material.

The basic principle upon which the invention is based is that the water bed material into which the anchoring device is to be sunk is transferred through a centrally located suction passageway from immediately beneath the anchoring device to a point above the anchoring device such that the anchoring device progressively buries itself into the water bed.

Referring initially to FIGS. 1 and 2 the anchoring device of a first embodiment of the invention has a body portion 10, a skirt portion 11 and extending vertically through the centre of the anchoring device a suction passageway 12. A conical portion 13 depends within the skirt portion 11 and fluidising water passageways 14 are located circumferentially around the suction passageway 12 and extend from a lower position in the space between the conical portion 13 and skirt portion 11 upwardly to an upper portion located in the free water above the water bed.

A solids-handling annular jet pump 15 fed by a water supply 17 operates to induce a mixture of water bed material and water up the suction passageway 12 to a point where it impinges upon an umbrella-like deflector 16 which deflects the mixture down and over the anchoring device.

Considering now FIG. 3 the geometry of the underside of the anchoring device of FIGS. 1 and 2 is illustrated relative to the natural angle of repose of the liquid bed material. It is well known in suction-dredging that a suction applied to a relatively free-running bed material results in a conical depression being formed in the bed material. The angle of slope of the conical depression relative to the horizontal plane is defined as being the angle of repose of the bed material. If this angle is designated as $\alpha$ the cone half angle of the depression will be 90° minus $\alpha$ and the included angle of the depression will be 2 (90° minus $\alpha$). For sand the angle of repose, $\alpha$ is of the order of 30°.

It is therefore possible to bury an inverted conical shape into a bed material by suction pumping the bed material out through a hole in the apex of the conical body provided the included angle of the conical body is less than 2 (90° minus $\alpha$).

One of the main objects of the anchoring device of the present invention is that it can bury itself in the bed material with minimum disturbance to the bed material immediatedly surrounding it. In order to prevent the excavated hole from spreading beyond the base diameter of the inverted conical portion 13 it is necessary to provide the skirt portion 11 which will entrain the surrounding bed material by progressive scour. The depth of the skirt portion 11 relative to the conical portion 13 is also dicated by the angle of repose, $\alpha$ of the water bed material. Using the diagram of FIG. 3 i.e. assuming that the skirt portion 11 depends from the base of the conical portion 13, and taking the base diameter of the conical portion 13 as being D and its height as being H, the skirt portion 11 must be deeper than H minus D/2 tan $\alpha$.

With this particular geometry it will be seen that there is always provided a space between the conical portion 13 and the water bed material into which fluidising water can be admitted to aid scouring of the water bed material. Additionally the skirt portion 11 will always be embedded into the bed material such that the natural scouring action is restricted to within the diameter of the skirt portion 11 with the result that the surrounding bed material is left unaffected.

Referring now to FIG. 4 a cylindrical member 40 is positioned within the base region of the conical porton 13 to provide an annular space 41 between the sloping sides and the base of the conical portion 13. Apertures 42 are provided in the sloping side of the conical portion 13 to provide a fluid communication between the annular space 41 and the space contained between the conical portion 13 and the skirt portion 11.

With this particular arrangement fluidising water may be made available in the region of the base of the conical portion 11 without the need for individual fluidising water passageways (compare fluidising water passageways 14 of FIG. 1). The annular space 41 need be fed with fluidising water from only a small number of fluidising water passageways 43.

The operation of the anchoring device described above with reference to FIGS. 1 to 4, is simple and straight forward. It is assumed that the nature of the water bed material into which the anchoring device is to bury itself is known and that the underside has been designed in accordance with FIG. 3 and also that the depth to which the anchoring device will bury itself is also known such that the fluidising water passageways 14 are sufficiently long to remain in the free water above the water bed for the duration of the movement of the anchoring device. With these criteria met the supply of jet water to the jet pump 15 is switched on. The annular jet of water then passing up the upper regions of the suction passageway 12 induces a mixture of the water bed material and the water to be drawn up the centre of the suction passageway 12 to a point where it impinges upon and is deflected by the umbrella-like deflector 16. In this manner water bed material is transferred from immediately below the anchoring device to a position immediately above the anchoring device. As the depth of the anchoring device increases and the bed material becomes more densely packed i.e. there is a reduced volume of naturally available water, the suction induced at the open end of the suction passageway 12 also acts to draw fluidising water from above the liquid bed via the fluidising water passageways 14. This enables the anchoring device to bury itself still deeper in the bed material irrespective of the local environment which might otherwise be hostile to efficient suction dredging.

The exact amount of fluidising water made available at the head of the anchoring device is dependent upon for example the number of and diameter of the fluidising liquid passageways 14 or 43. In a particular anchoring device on which preliminary experiments have been conducted the outer diameter of the skirt portion 11 was 30 cm and its height was 12 cm, the conical portion 13 had an included angle of 90° and a height of 15 cm. The anchoring device also had eight equally pitched fluidising water passageway pipes 14 each of 20 mm bore and with a jet supply pressure of 300 kN/m$^2$ the anchoring device buried itself stably at a constant rate of approximately 5 mm per second. The particular design described provided potentially more than an adequate supply of fluidising water but this is a matter which would require to be optimised for the application in hand. It should be noted that an excess of fluidising water will not cause malfunction of the anchoring device but merely a decrease in its burial rate.

The anchoring device described above with reference to FIGS. 1 to 4 has proved most successful in burying itself into sandy bed materials. Its efficiency however has been somewhat limited when used in mixed bed materials including sticky cohesive substances such as clays and muds.

For this reason there is now described a second embodiment of the invention with reference particularly to FIGS. 5, 6 and 7.

Referring initially to FIG. 5, the anchoring device of the second embodiment comprises a main body member 10 of generally cylindrical form having a open based conical portion 51 in its lower region. A central suction passageway 12 extends through the body member 10 from the apex region of the conical portion 51. The included cone angle of the conical portion 51 is 90° although the angle is not critical.

An annular chamber 53 formed in the lower region of the body member 10 between its outside wall and the lower region of the conical portion 51, is arranged to contain fluidising water under pressure fed from a water source via a water inlet pipe 54. Two rows of fluidising jets (holes) 55 are provided through the inner circumferential boundary wall of the annular chamber 53, the upper row of jets 55 being arranged to direct a sheet of fluidising water in a substantially horizontal plane and the lower row of jets 55 being arranged to direct a curtain of fluidising water downwardly in a substantially vertical direction.

An air-lift pump is provided in the suction passageway 12 and comprises simply four equally spaced apertures 56 which in use are fed with compressed air via the air inlet pipe 57.

In operation the anchoring device is lowered through the water to rest on the bed material in which the anchorage is required. Fluidising water is supplied under pressure to the fluidising water chamber 53 and compressed air is similarly supplied via the apertures 56 to initiate operation of the air-lift pump. The fluidising water emitting through the fluidising jets 55 acts on the bed material immediately beneath the body member 10 and in conjunction with suction from the air-lift pump causes the solid bed material to be extracted through the suction passageway 12. As bed material is thus removed from beneath the body member 10 the weight of the anchoring device as a whole causes it to move into the excavated area so burying itself. This progressive movement is maintained until the anchoring device has reached a desired depth in the bed material. It is essential of course that the upper end of the suction passageway 12 shall extend at least to the datum bed material level when the anchoring device is at its deepest point of travel so that the excavated bed material can be ejected into the free flowing water above the bed.

The arrangement of FIG. 6 shows an alternative design of the anchoring device of the second embodiment of the invention in which the fluidising water is provided via a perforated toroidal ring 60 located around the inner peripheral base region of the conical portion 51. As with the arrangement of FIG. 5 water under pressure is supplied to the toroidal ring 60 via a water inlet pipe 54. The toroidal ring 60 is provided with a series of water jet holes 65, one row being positioned in the plane of the ring 60 and operative to provide a series of radially directed jets of water and a further row of fluidising jets 65 each arranged normal to the plane of the ring 60 and operative to cause a substantially cylindrical curtain of water jets. Operation of the anchoring device is identical to that described relative to the design of FIG. 5.

Referring now to FIG. 7, there is shown schematically a form which a typical production anchoring device of the second embodiment might take. The body member 10 and conical portion 51 are fabricated in for example, steel plate, the top of the body member 10 including a stressed platform member 70. The volume between the plate fabricated body member and the stressed platform 70 can conveniently be filled with any dense or relatively dense mixture of rubble and concrete 71. Normal plumbing (not shown) for the supply of fluidising water under pressure and also for the supply of compressed air to operate the air lift pump would be designed into the device before such a concrete mix were poured.

Above the anchoring device and attached to the stressed platform 70 would be webbed attachment members to which mooring cables etc. could be attached.

Preliminary trials with anchoring devices made in accordance with FIGS. 5 and 6 have shown that they can successfully be buried into soft mud and other cohesive materials. In one trial for example an anchoring device of the type shown in FIG. 6 was buried to a depth of 7 meters in about 40 minutes. The device was of 30 cm outside diameter and required a pull in excess of 6 tons to remove it.

Experimentation with the anchoring device of the second embodiment led to a further main design within the principles of the invention and this is now described as the third embodiment with reference particularly to FIGS. 8 and 9.

Referring to FIG. 8 the anchoring device of the third embodiment comprises a main body member 10 having a flat circular top portion 80 and depending therefrom a cylindrical skirt member 81. The central suction passageway 12 extends from the space contained within the skirt member 81 upwardly through the flat top portion 80. An annular chamber 82 formed in the flat top portion 80 is arranged to contain fluidising water fed from a water source via a water inlet pipe 83.

A central fluidising nozzle 84 is positioned immediately beneath the central suction passageway 12 and is fed by means of feed pipes 85 connected at their reverse ends with the annular chamber 82. The fluidising nozzle 84 includes a vertically directed jet 87 and horizontally directed jets 88. The horizontally directed jets 88 might alternatively be angled downwardly as shown in FIG. 9.

Although the feed pipes 85 of FIG. 8 are structurally self-supporting (three pipes at 120° spacing) the twin feed pipes 85 of FIG. 9 are structurally stabilised by web members 86.

An air-lift pump is provided in the central suction passageway 12 and comprises simply an air jet nozzle 90 which in use is fed with compressed air via an air inlet pipe 91. FIG. 8 additionally includes secondary fluidising jets 89 in the form of short cranked tubes which are located circumferentially around the annular chamber 82 and are arranged such that in use they will direct fluidising water to the lower circumferential skirt periphery region of the body member 10.

The efficiency of the design of the anchoring device of the third embodiment with its leading fluidizing nozzle 84 is such that the whole bed material beneath the anchoring device is fluidised and the provision of the additional secondary fluidising jets 89 (FIG. 8) is largely redundant.

Although suction is applied to the suction passageway 12 by means of an air-lift pump it could equally as well be provided by means of a water-jet or a solids handling pump although as will be appreciated the choice of pump is largely dependent upon the operating conditions, particularly the depth. An air-lift pump is most efficient in relatively shallow depths.

One example of this design of anchoring device which has been successfully tested had an overall skirt 81 diameter of 61 cm, a flat top portion 80 thickness of about 7.5cm, a depended skirt depth of about 18 cm and with the central fluidising nozzle 84 positioned about 20 cm beneath the lower peripheral portion of the skirt member 81.

FIG. 10 illustrates a fourth embodiment of the invention in which the suction in the suction passageway 12 is generated by means of a water-jet pump. The anchoring device comprises a flat circular base or platform member 110 and depending therefrom a cylindrical skirt member 111. A centrally located suction passageway 112 extends from the space contained within the skirt member 111 upwardly through the platform member 110. An annular chamber 113 is formed within the platform member 110 and is arranged to contain fluidising water fed from a water source via a water inlet pipe 114.

A fluidising nozzle head 115 is positioned axially in line with and immediately beneath the centrally located suction passageway 112 and is provided with jet orifices 116 positioned to supply a generally downwardly directed spray of fluidising water from the nozzle head 115. A curved feed pipe 117 feeds fluidising water from the annular chamber 113 to the fluidising nozzle head 115 via a T-branch pipe 118. A T-branch pipe 119 similarly feeds fluidising water from the annular chamber 113 to a water-jet nozzle 120 located within an enlarged circular opening 121 at the lower open region of the suction passageway 112. Fluidising nozzle head 115, water jet pump nozzle 120, and suction passageway 112, at least in the region of the anchoring device body, are all axially in line.

A hawser or like attachment eye 122 is provided in an upstanding flange member 123 attached to the platform member 110 and structurally reinforced by cross strengthening flange members 124.

In use of the fourth embodiment of the invention water is supplied to the water-jet nozzle 120 and the fluidising nozzle head 115 whereby the water introduced into the bed material via the nozzle head 115 causes fluidisation of that bed material whilst the water ejected into the suction passageway 112 through the water-jet nozzle 120 induces the fluidized bed material to be drawn up through the suction passageway 112 and discharged.

In a fifth embodiment of the invention illustrated in FIG. 11 and 12, the suction to induce the fluidised bed material through the body of the anchoring device is provided by a centrifugal pump powered by an hydraulic motor and mounted on or in the body of the anchoring device. The main features of the anchoring device of this embodiment are similar to those of the third and fourth embodiments and, where applicable, reference numerals used in the fourth embodiment will be used for like components in this embodiment. In this embodiment, FIG. 11, the fluidising nozzle head 115 is supplied by twin curved feed pipes 117 and is additionally supported by structural web members 125.

A centrifugal pump 130 capable of handling solids is mounted within the platform member 110 and is powered by an hydraulic motor 131. Hydraulic feed and return pipes 132 and 133 serve the motor 131. The centrifugal pump 130 comprises essentially an impeller plate member 134 attached to the rotatable portion of the hydraulic motor 131 (conveniently its housing) and two impeller blades 135 dependent therefrom. The outer casing 136 of the centrifugal pump 130 is of volute form in section (FIG. 12) and might conveniently be formed within the platform member 110 of the anchoring device. A discharge passageway 137 from the centrifugal pump 130 extends upwardly from the anchoring device and together with the suction passageway 112 and the volute through passageway in the centrifugal pump 130 constitutes a through path for the fluidised bed material to be transferred in use from beneath to above the anchoring device. The hydraulic motor 131 has been designed to operate successfully on water or sea-water and the centrifugal pump 130 is capable of passing solids up to 80 mms diameter. In this instance the return pipe 133 can exhaust into the free flowing water.

Throughout this specification reference has repeatedly been made to the supply to the underside of the anchoring device of fluidising water to fluidise the bed material and convert it to a pumpable medium of solid matter in suspension in water. It will be understood that the fluidising water might be supplied from an independent pressure source, either at the water surface level or submerged, via pressure pipe umbilicals or that the fluidising water might be supplied under induced pressure. By induced pressure is meant simply the pressure difference between the hydrostatic pressure existing at the upper free end of the fluidising water supply pipe and the considerably lower pressure immediately beneath the anchoring device and generated by the suction from the suction passageway.

In shallow depths it is likely that the fluidising water would be supplied from an independent pressure source whereas in deeper depths where hydrostatic pressures are greater and the managing of long umbilical feeds more difficult the supply of fluidising water by induced pressure is to be preferred.

When the fluidizing water is introduced ahead of the anchoring device and the sinking of the anchoring device is dependent upon the supply of induced fluidizing water it is necessary to ensure that the skirt 111 (see for example FIG. 11) enters the bed material and creates a seal so that the suction means employed in the anchoring device can generate a low pressure region. The fluidizing water nozzle head 115 however, with no flow through it, enters the bed material ahead of the skirt 111 and could therefore become sufficiently buried before the required pressure differential is built up so that induced flow could not be initiated. To obviate this it is proposed that, solely for the purposes of establishing the necessary skirt 111 seal, fluidizing water under independent pressure should be supplied to the fluidizing nozzle head 115 until the pressure differential has been established. One means of achieving this is shown in FIG. 11 in which relatively high pressure water from the centrifugal pump 130 is bled through scouring lines 138 to the nozzle head 115 and jets 116 to keep them clear by jet-pump action during their initial burial. This is made possible by operating the centrifugal pump 130 which at this stage would be pumping only clear water. Alternatively the necessary scouring action could be achieved by a constant small bleed from the high pressure supply of water to the hydraulic motor 131. When suction is by means of an air-lift pump (see for example FIGS. 8 & 9) air might be bled to the nozzle 84 from the air-lift pump supply.

Operation of the anchoring devices of the third, fourth and fifth embodiments (FIGS. 8 through 12) is similar to that described relative to the anchoring devices of the first and second embodiments. The anchoring device is lowered to the water/water bed interface and suction applied to the suction passageway 12, 112 whilst at the same time fluidizing water is supplied via the inlet pipe 83, 114, annular chamber 82, 113 and feed pipes 85, 117 to the nozzle head 84, 115 from where it is discharged through the jet orifices 87, 88, 116 to fluidize the bed material directly beneath and in advance of the suction passageway 12, 112. The fluidized bed material is then transferred through the suction passageway 12, 112 and discharged into the free flowing water above the water bed. The anchoring device therefore is continuously fluidizing the bed material beneath itself, transferring this fluidized bed material through the suction passageway 12, 112 thereby creating an excavation into which the anchoring device will drop. As the process is continued the anchoring device will bury and continue to bury itself into the water bed material.

FIG. 13 shows an anchoring device 100 according for example to the second (FIGS. 5, 6 and 7) or the third (FIGS. 8 and 9) embodiments of the invention buried in a water bed material 101. It will be noted that the suction passageway 12 extends into the free running water 102 above the bed material 101. It should also be noted that the fluidizing water is here being supplied from the surface via feed pipes 54, 83 and the suction generated in the anchoring device 100 results from an air-lift pump fed with air under pressure through feed pipes 57, 91. In contrast FIG. 14 shows an anchoring device 200 according to for example the fifth (FIGS. 11 and 12) embodiment of the invention buried in a water bed material 201. It will be noted again that the suction passageway 137 (extension of 112) extends into the free running water 202 above the bed material 201 but that the fluidizing water for the anchoring device 200 is supplied under induced pressure and that accordingly the length of the feed pipe 114 need only just exceed the final depth of burial and be retained such that its upper free end is always in the free running water 202. Water to power the hydraulic pump 131 is provided and exhausted via the pipes 132, 133. A hauser or mooring line 203 is secured to the anchoring device by means of the eye 122 before the anchoring device is sunk into the water bed material 201.

In known techniques of pressure scouring to allow an anchoring device to settle into a water bed material the general principles are to fluidize the bed material such that the weight of the anchoring device causes it to settle whilst the bed material passes around and engulfs it much like in a quick sand. Such techniques are not fully controllable and when operating in layers of cohesive material the scouring jets tend to consolidate the cohesive bed material rather than to separate and fluidise it.

The anchoring device of the present invention is more similar to a pin pile than to a conventional anchor and is capable of being driven into a variety of liquid bed materials. The anchoring device develops a high resistance to pull out as well as lateral movement.

Although the anchoring device of the invention is intended primarily as a means of providing a permanent anchorage, there may be provided in the region immediately above the anchoring device additional fluidising jet means whereby the bed material above the anchoring device may be fluidized to facilitate easy withdrawal. Such additional fluidizing jet means are shown, for example, in FIG. 8 as applied to the third embodiment of the invention. The additional fluidising jet means comprise a toroidal ring 92 provided with a series of outwardly directed, circumferentially disposed jet holes 93, the fluidizing water being fed to the toroidal ring 92 via an inlet pipe 94.

The particular advantages of the anchoring device of the invention are that relative to conventional anchors it has potentially a high holding power/weight ratio, buries itself precisely at the point at which it is dropped and can accept a steep angle of pull. Relative to pile anchors it drives itself in independent of depth and relative to gravity systems it is of low weight.

Its obvious limitations are that it will not work in very stiff clays or rock beds, may require an independent pumped water supply from the surface when used in shallow water and/or in strongly compacted sea bed material and must be laid from a stationary surface vessel.

The following examples are some of the many applications envisaged:

- Single anchoring devices for single point moorings for large vessels.
- Multiple anchoring devices for single point moorings for large vessels.
- Underpinning gravity based structures to provide lateral restraint.

Light piling applications (for example channel marker piles, underwater breakwaters, pipeline anchorage).

It will be readily appreciated by those skilled in the art that the variations on the general design of the anchoring device of the present invention whilst retaining the broad principles of the invention are as numerous as the applications to which it might be put. In this respect the foregoing description is in no way to be taken as having a limiting effect of the invention.

I claim:

1. A deep burying anchoring device for providing an anchorage in the bed of a volume of water comprising
a body member including an open-ended cylindrical skirt portion,
a conical portion mounted coaxially within the skirt portion in an inverted state with its apex extending downwardly,
a suction passageway extending at least part way through the body member and having an open lower end extending through the apex of the conical portion, and fluidising water outlet means located in the region of the base of the conical portion and shielded within the skirt portion whereby in use, and with suction applied to the suction passageway and fluidising water made available through the outlet means, a mixture of bed material/water from immediately below the body member is drawn up the suction passageway and discharged above the body member whereby the body member will bury and continue to bury itself deeper into the water bed material.

2. A deep burying anchoring device for providing an anchorage in the bed of a volume of water comprising
a body member including an open ended cylindrical skirt portion,
a conical portion mounted coaxially within the skirt portion and with the apex region of the conical portion extending below the open end of the skirt portion,
a suction passageway located along the axis of the skirt and conical portions and extending through the apex region of the conical portion,
fluidising water passageways arranged circumferentially around the suction passageway and having their lower ends extending through the wall of the conical portion into the space bounded by the skirt and the conical portions whereby in use and with suction applied to the suction passageway a mixture of bed material/water from immediately below and within the skirt portion is drawn up the suction passageway and discharged over and above the anchoring device, necessary fluidising water for the efficient continued operation of the device being provided to the bed material via the fluidising water passageways.

3. A deep burying anchoring device according to claim 2 in which there is provided opposite the upper open end of the suction passageway an umbrella-like deflector which in use deflects the induced solids/water mixture drawn up from below the body member such that it settles over the body member.

4. A deep burying anchoring device for providing an anchorage in the bed of a volume of water comprising:
a body member including a conical portion,
a suction passageway extending at least part way through the body member and including an open lower end extending through the apex of the conical portion, and
fluidising water outlet means in the form of a toroidal ring located around the base of the conical portion and having a series of apertures in the inner circumferential region through which in use fluidising water can be directed into the general region of the lower open end of the suction passageway.

5. A deep burying anchoring device for providing an anchorage in the bed of a volume of water comprising:
a body member comprising essentially a platform portion and depending therefrom a cylindrical skirt portion,
at least one suction passageway extending at least part way through the body member and including an open lower end,
means for providing suction in the suction passageway, and
fluidising water outlet means located beneath the body member and positioned coaxially with the lower open end of the suction passageway such that in use fluidising water made available through the outlet means acts to fluidise the bed material immediately below the body member to enable it to be transferred, through the suction passageway as solids in suspension in water, from below the body member and discharged above the body member whereby the body member will bury and continue to bury itself deeper into the water bed material.

6. A deep burying anchoring device according to claim 5 in which there is provided a single suction passageway extending at leat through the platform portion in the central region of the body member.

7. A deep burying anchoring device according to claim 6 in which the fluidising water outlet means include secondary fluidising water outlet means located in the general region of the lower open end of the suction passageway.

8. A deep burying anchoring device according to claim 6 in which there are provided means for releasing the anchoring device from a position within the water bed material by the controlled release of water under pressure in the region immediately above the body member of the anchoring device.

9. A deep burying anchoring device according to claim 6 in which the means for providing suction in the suction passageway to induce solids in suspension in water to pass through the passageway comprises an air-lift pump operative by introducing air under pressure into the suction passageway just above its lower open end.

10. A deep burying anchoring device according to claim 6 in which the fluidising water outlet means is a single jet nozzle positioned coaxially with the suction passageway a short distance beneath the lower periphery of the skirt portion so as to be at the apex of an imaginary shallow cone formed with the lower periphery of the skirt portion as its base.

11. A deep burying anchoring device according to claim 10 in which the jet nozzle includes fluidising jets disposed to direct in use fluidising water in a substantially downwardly direction.

12. A deep burying anchoring device according to claim 5 in which the means for providing suction in the suction passageway to induce solids in suspension in water to pass through the suction passageway is a water-jet pump.

13. A deep burying anchoring device according to claim 12 in which the water-jet pump is fed in use with water from the same source as that supplying fluidising water to the fluidising water outlet means.

14. A deep burying anchoring device according to claim 5 in which the means for providing suction in the suction passageway to induce solids in suspension in water to pass through the passageway is a centrifugal pump located on the anchoring device.

15. A deep burying anchoring device according to claim 14 in which the centrifugal pump is powered in use by an hydraulic motor.

16. A deep burying anchoring device according to claim 15 in which the hydraulic motor is operated with water as its working medium.

17. A deep burying anchoring device according to claim 16 in which the fluidising water outlet means is in fluid connection with a supply passageway adapted in use to extend into the free-flowing water above the bed material whereby fluidising water is supplied to the fluidising water outlet means by induced pressure.

18. A deep burying anchoring device according to claim 5 in which the means for providing suction in the suction passageway to induce solids in suspension in water to pass through the passageway comprises an airlift pump operative by introducing air under pressure into the suction passageway just above its lower open end.

19. A deep burying anchoring device according to claim 18 in which the fluidising water outlet means are in fluid connection with a supply passageway adapted in use to extend into the free flowing water above the bed material whereby fluidising water is supplied to the fluidising water outlet means by induced pressure.

* * * * *